US010010767B1

(12) United States Patent
Stach

(10) Patent No.: US 10,010,767 B1
(45) Date of Patent: Jul. 3, 2018

(54) BASEBALL HOLDER FOR AN AUTOGRAPH SEEKER

(71) Applicant: David W Stach, Fort Worth, TX (US)

(72) Inventor: David W Stach, Fort Worth, TX (US)

( * ) Notice: Subject to any disclaimer, the term of this patent is extended or adjusted under 35 U.S.C. 154(b) by 93 days.

(21) Appl. No.: 15/132,361

(22) Filed: Apr. 19, 2016

Related U.S. Application Data

(60) Provisional application No. 62/152,147, filed on Apr. 24, 2015.

(51) Int. Cl.

| | |
|---|---|
| ***B65D 85/00*** | (2006.01) |
| ***A63B 47/00*** | (2006.01) |
| ***B65D 25/30*** | (2006.01) |
| *B65H 75/44* | (2006.01) |

(52) U.S. Cl.
CPC ..... *A63B 47/00* (2013.01); *B65D 25/30* (2013.01); *B65D 85/70* (2013.01); *B65H 75/4494* (2013.01)

(58) Field of Classification Search
CPC ..... B65D 5/52; B65D 85/58; B43K 23/001; B43K 29/00; G09F 19/00
USPC ..... 206/224, 315.9, 315.91, 486, 575, 579, 206/775, 779
See application file for complete search history.

(56) References Cited

U.S. PATENT DOCUMENTS

| | | | | |
|---|---|---|---|---|
| 2,551,354 | A * | 5/1951 | Wasilevich | A47F 7/00 206/315.9 |
| 2002/0084201 | A1* | 7/2002 | Murray | B65D 5/5019 206/315.9 |
| 2007/0051658 | A1* | 3/2007 | Schroeder | B43K 23/001 206/579 |
| 2009/0019738 | A1* | 1/2009 | Cunningham | B43K 23/001 40/1 |
| 2014/0143033 | A1* | 5/2014 | Cecchi | B65D 75/36 705/14.4 |
| 2015/0001103 | A1* | 1/2015 | Huynh | A45C 11/16 206/6.1 |

* cited by examiner

*Primary Examiner* — Luan K Bui
(74) *Attorney, Agent, or Firm* — Kenneth L. Tolar

(57) ABSTRACT

A baseball holder for an autograph seeker includes a hollow housing having a bottom wall, a planar top wall, a pair of sidewalls and a pair of end walls. The bottom wall includes a pair of spaced slots that allow a celebrity to more easily grasp the housing when signing a baseball. On the top wall is a circular opening in communication with an interior chamber having a pair of reciprocal gripping members therein for securing a baseball to the housing. Accordingly, when a baseball is secured within the opening, the planar top wall provides a comfortable support surface for the celebrity's writing hand.

16 Claims, 2 Drawing Sheets

BASEBALL HOLDER FOR AN AUTOGRAPH SEEKER

CROSS REFERENCE TO RELATED APPLICATIONS

This application is entitled to the benefit of provisional patent application No. 62/152,147 filed on Apr. 24, 2015, the specification of which is incorporated herein by reference.

BACKGROUND OF THE INVENTION

The present invention relates to a device that allows an autograph seeker to more easily present a baseball to a desired player.

DESCRIPTION OF THE PRIOR ART

When obtaining an autograph, a fan typically presents a baseball and a writing instrument to a desired celebrity/baseball player. The spherical ball is difficult to grasp and provides an irregular writing surface that often produces an atypical or illegible signature that is useless. The fan also must battle a crowd of other autograph seekers in order to retrieve the autographed ball and the writing instrument. As a result, the ball and writing instrument are often lost during the exchange.

Accordingly, there is currently a need for a device that allows a player to more easily autograph a baseball. The present invention addresses this need by providing a holder that secures a baseball to a planar writing surface to facilitate signing by a celebrity.

SUMMARY OF THE INVENTION

The present invention relates to a baseball holder for an autograph seeker comprising a housing having a bottom wall, a planar top wall, a pair of sidewalls and a pair of end walls. The bottom wall includes a pair of spaced slots that allow a celebrity to more easily grasp the housing when signing a baseball. On the top wall is a circular opening having a pair of reciprocal gripping members therein that secure a baseball to the housing. Accordingly, when a baseball is secured within the opening, the planar top wall provides a comfortable support surface for the celebrity's writing hand.

It is therefore an object of the present invention to provide a device that allows a celebrity to more easily autograph a baseball.

It is therefore another object of the present invention to provide a device that allows a fan to more easily present a baseball to a player.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
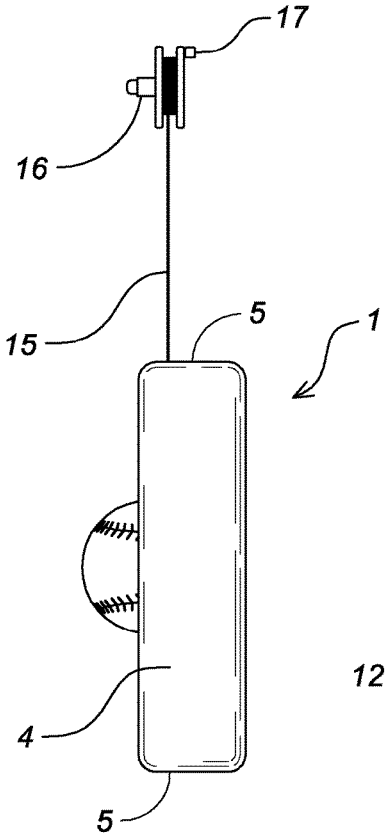
FIG. 1 is a side view of the holder according to the present invention.
Figure 2:
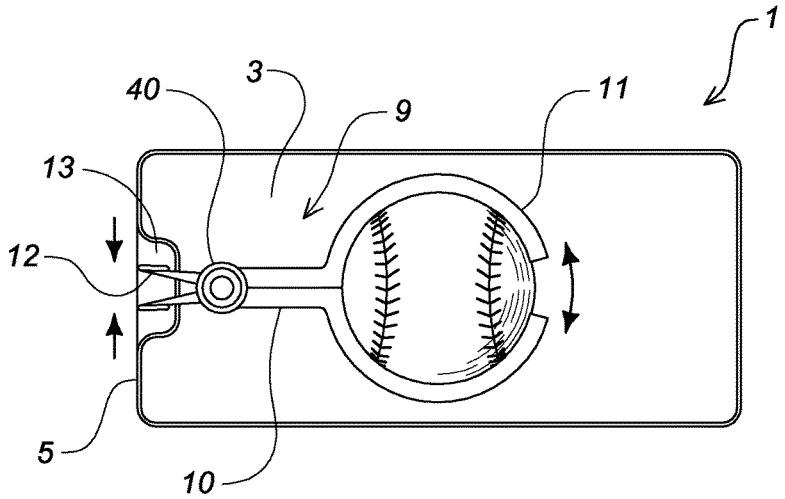
FIG. 2 is a top view of the holder.
Figure 3:
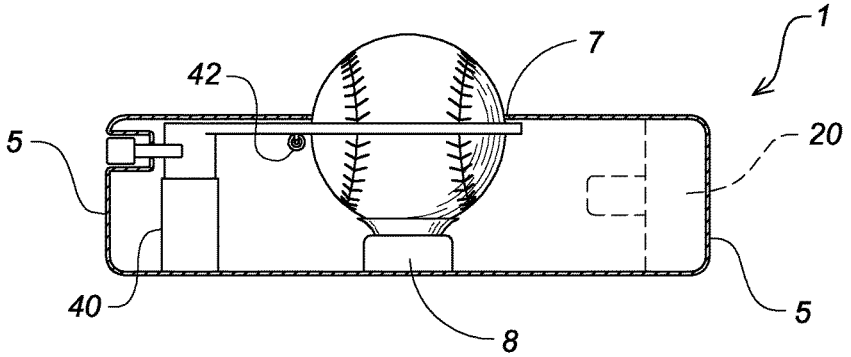
FIG. 3 is a front, sectional view of the holder.
Figure 4:
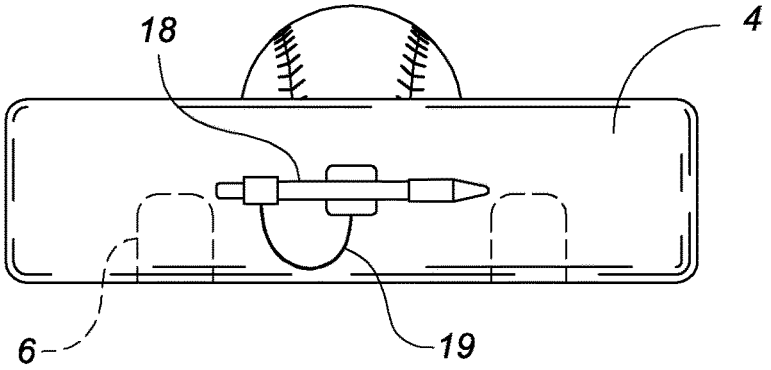
FIG. 4 is a rear view of the holder.
Figure 5:
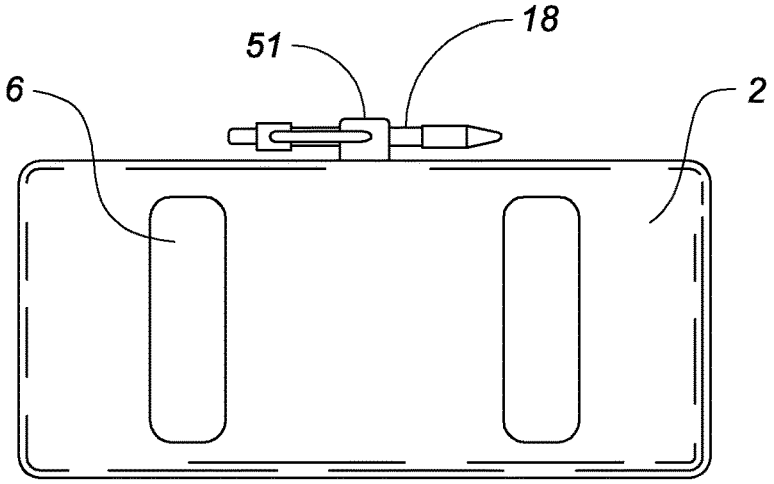
FIG. 5 is a bottom view of the holder.
Figure 6:
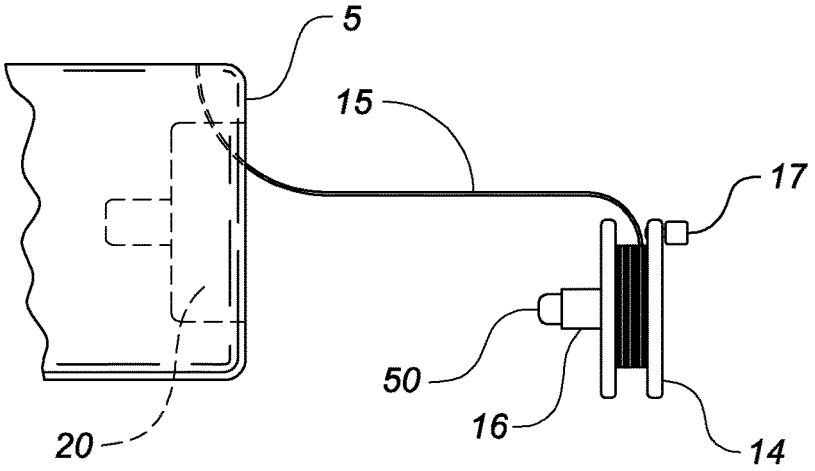
FIG. 6 is a cutaway view of the housing, depicting the spool and designated storage recess.

The present invention relates to a baseball holder comprising a housing 1 having a bottom wall 2, a planar top wall 3, a pair of sidewalls 4 and a pair of end walls 5. The bottom wall 2 includes a pair of spaced slots 6 that allow a celebrity to more easily grasp the housing when signing a baseball. On the top wall is a circular opening 7 superimposed on a spring-biased collar 8 for supporting the baseball on the housing. Within the opening are a pair of reciprocal gripping members 9, each including an arm 10 with an arcuate, semicircular jaw 11 at one end and a tab 12 at an opposing end. Preferably, an inner surface of each jaw includes a rubber coating to more securely grip a baseball. The arms are pivotally attached to a support post 40 to allow the jaws to open and close in a clamshell-like fashion. Preferably, the support post is movable within the housing to optimally position the jaws relative to the opening. A biasing spring 42 maintains the jaws in a closed position when released. The tabs 12 are located within an indention 13 on one of the end walls so that a user can easily compress the tabs to open the jaws when securing or releasing a baseball. When the tabs are released, the jaws firmly close about the circumference of the baseball to secure it within the opening.

On the opposing end wall is a recess 20 with a spool 14 removably received therein. A string or cord 15 spirally wrapped about the spool is secured to the housing for lowering the device from an elevated position. The spool includes a handle 16 on one side that a user grasps while rotating a crank 17 on the other side to raise and lower the housing. A ball detent 50 at a distal end of the handle locks the spool within the recess 20 when not in use. A helical, expandible cord 19 tethers a writing instrument 18 to one of the sidewalls for the player's convenience. The instrument 18 is stored within one or more clips 51 until needed.

Accordingly, when obtaining an autograph, a fan compresses the tabs, places the ball in the opening, resting on the collar, releases the tabs to anchor the ball and presents the housing to a desired celebrity. If the fan is in an elevated position, such as in stadium bleachers, he or she removes the spool, grasps the handle and rotates the spool in a first direction to lower the housing to ground level. When the celebrity grasps the lower wall with the non-dominant hand, the planar top wall provides a comfortable support surface for the celebrity's writing hand while signing the baseball. When finished, the user can easily retrieve the housing by rotating the spool in an opposite direction to retract the cord. The fan then compresses the tabs to open the jaws, causing the spring-biased collar to eject the ball from the opening.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A baseball holder for an autograph seeker comprising:

a housing having a planar top wall and a bottom wall;

a ball opening on the top wall;

means for releasably retaining a ball within said opening whereby said top wall provides a planar surface for supporting a celebrity's writing hand when autographing the ball;

means for ejecting said ball from said opening.

2. The baseball holder according to claim 1 further comprising a writing instrument secured to said housing.

3. The baseball holder according to claim 1 wherein said means for releasably retaining a ball within said opening comprises:

a pair of reciprocal, spring-biased jaws within said opening that open and close in a clamshell-type fashion to secure and release the ball.

4. The baseball holder according to claim 3 wherein said means for ejecting the ball from said opening comprises a spring-biased collar beneath said opening on which the ball is positioned whereby when said jaws are open, said collar ejects the ball from said opening.

5. The baseball holder according to claim 1 further comprising:

a recess on said housing;

a spool removably received within said recess;

a cord spirally wrapped about said spool;

a crank on said spool that is rotated to raise and lower the housing;

a handle on said spool that a user grasps when rotating said crank.

6. The baseball holder according to claim 1 further comprising a pair of spaced slots on the bottom wall of said housing to allow a celebrity to more easily grasp the housing when signing the ball secured within said opening.

7. A baseball holder for an autograph seeker comprising:

a housing having a planar top wall and a bottom wall;

a ball opening on the top wall;

means for releasably retaining a ball within said opening whereby said top wall provides a planar surface for supporting a celebrity's writing hand when autographing the ball;

a recess on said housing;

a spool removably received within said recess;

a cord spirally wrapped about said spool;

a crank on said spool that is rotated to raise and lower the housing;

a handle on said spool that a user grasps when rotating said crank.

8. The baseball holder according to claim 7 further comprising a writing instrument secured to said housing.

9. The baseball holder according to claim 7 wherein said means for releasably retaining a ball within said opening comprises:

a pair of reciprocal, spring-biased jaws within said opening that open and close in a clamshell-type fashion to secure and release the ball.

10. The baseball holder according to claim 9 further comprising a spring-biased collar beneath said opening on which the ball is positioned whereby when said jaws are open, said collar ejects the ball from said opening.

11. The baseball holder according to claim 7 further comprising a pair of spaced slots on the bottom wall of said housing to allow a celebrity to more easily grasp the housing when signing the ball secured within said opening.

12. A baseball holder for an autograph seeker comprising:

a housing having a planar top wall and a bottom wall;

a ball opening on the top wall;

means for releasably retaining a ball within said opening whereby said top wall provides a planar surface for supporting a celebrity's writing hand when autographing the ball, wherein said means for releasably retaining a ball within said opening comprises a pair of reciprocal, spring-biased jaws within said opening that open and close in a clamshell-type fashion to secure and release the ball.

13. The baseball holder according to claim 12 further comprising a writing instrument secured to said housing.

14. The baseball holder according to claim 12 further comprising a spring-biased collar beneath said opening on which the ball is positioned whereby when said jaws are open, said collar ejects the ball from said opening.

15. The baseball holder according to claim 12 further comprising:

a recess on said housing;

a spool removably received within said recess;

a cord spirally wrapped about said spool;

a crank on said spool that is rotated to raise and lower the housing;

a handle on said spool that a user grasps when rotating said crank.

16. The baseball holder according to claim 12 further comprising a pair of spaced slots on the bottom wall of said housing to allow a celebrity to more easily grasp the housing when signing the ball secured within said opening.

* * * * *